US007395799B2

(12) United States Patent
Liang et al.

(10) Patent No.: US 7,395,799 B2
(45) Date of Patent: Jul. 8, 2008

(54) PRIMARY HOUSING ASSEMBLY FOR A MOTORCYCLE ENGINE

(75) Inventors: Paul Nan-Jiune Liang, Menomonee Falls, WI (US); Richard G. Pierson, New Berlin, WI (US); Scott J. Nash, Muskego, WI (US); Alexander J. Bozmoski, Brookfield, WI (US); Peter J. Duvernell, Colgate, WI (US); Sean A. Rusch, Cedarburg, WI (US); William M. Kernen, Muskego, WI (US); John W. Schanz, Mequon, WI (US); Samir Mesanovic, Howards Grove, WI (US); Brian P. Dondlinger, Milwaukee, WI (US)

(73) Assignee: Harley-Davidson Motor Company Group, Inc., Milwaukee, WI (US)

( * ) Notice: Subject to any disclaimer, the term of this patent is extended or adjusted under 35 U.S.C. 154(b) by 0 days.

(21) Appl. No.: 11/550,550

(22) Filed: Oct. 18, 2006

(65) Prior Publication Data

US 2007/0056550 A1 Mar. 15, 2007

Related U.S. Application Data

(62) Division of application No. 11/174,427, filed on Jul. 1, 2005, now Pat. No. 7,174,875.

(51) Int. Cl.
*F02B 77/00* (2006.01)
*F02B 77/13* (2006.01)

(52) U.S. Cl. ..... 123/195 C; 181/204

(58) Field of Classification Search ..... 123/195 C, 123/198 E; 181/204, 208
See application file for complete search history.

(56) References Cited

U.S. PATENT DOCUMENTS 4,030,553 A 6/1977 Rockwell
4,516,658 A 5/1985 Scarton et al.
6,834,741 B2 * 12/2004 Miller et al. ..... 180/313

FOREIGN PATENT DOCUMENTS

JP 56159520 A * 12/1981

* cited by examiner

*Primary Examiner*—Noah Kamen
(74) *Attorney, Agent, or Firm*—Michael Best & Friedrich LLP

(57) ABSTRACT

A primary housing for a motorcycle engine includes an inner housing that defines internal coupling apertures, transmission coupling apertures, and external coupling apertures. Internal fasteners extend through the internal coupling apertures and the transmission coupling apertures to couple the inner housing to the crankcase and the transmission. An outer housing defines coupling apertures that align with the external coupling apertures and fasteners extend through the coupling apertures, through the external coupling apertures, and into the engine crankcase to couple the inner and outer housings to the crankcase. A resonant damping device is rigidly or moveably coupled to an anti-node region of the outer housing to reduce noise emissions from the outer housing during engine operation.

20 Claims, 6 Drawing Sheets

PRIMARY HOUSING ASSEMBLY FOR A MOTORCYCLE ENGINE

CROSS-REFERENCE TO RELATED APPLICATIONS

This application is a divisional of application Ser. No. 11/174,427 filed Jul. 1, 2005 now U.S. Pat. No. 7,174,875, the entire contents of which is incorporated herein by reference.

BACKGROUND

The present invention relates to a primary drive housing assembly for a motorcycle engine. In a motorcycle engine in which the engine assembly is separate from the transmission assembly, a primary drive assembly is utilized to transfer rotary output from the engine crankshaft to an input shaft of the transmission assembly. The primary drive assembly can include a number of suitable power transmission elements including gearing arrangements, belt and pulley systems, and chain and sprocket systems. In addition to the power transmission elements of the primary drive assembly, many primary drive assemblies include housings that protect and/or support the power transmission elements. The housings may also function to contain oil or other fluids for lubrication of the power transmission elements.

In some instances the primary housing may comprise a relatively large and exposed portion of the motorcycle engine. As such, the aesthetic appearance of the housing may be of some concern. Furthermore, dynamic excitation forces, such as those generated during engine operation, may result in resonance of the primary housing. Such resonance can contribute to undesirable noise during vehicle operation.

SUMMARY

The invention provides an internal combustion engine including a crankshaft that defines a crankshaft axis, and a crankcase supporting the crankshaft for rotation about the crankshaft axis. The crankcase defines a first surface that extends around and is substantially normal to the crankshaft axis, and a plurality of threaded bores that extend through the first surface and are angularly spaced about the crankshaft axis. The engine also includes a transmission having an input shaft defining an input axis that is substantially parallel to the crankshaft axis. A primary housing defines a crankshaft opening through which the crankshaft extends, an input shaft opening through which the input shaft extends, and a second surface that faces the first surface. The primary housing is configured to house a primary drive assembly that drivingly couples the crankshaft and the input shaft. The primary housing includes an inner housing that defines the second surface, and an outer housing that is coupled to the inner housing. The inner housing and the outer housing define a plurality of coupling apertures substantially aligned with some of the threaded bores in the crankcase. Fasteners extend through the external coupling apertures and into the threaded bores to couple the outer housing to the inner housing and to couple the inner housing to the crankcase.

In another aspect, the present invention provides an internal combustion engine including an engine component that is adapted to be coupled to the internal combustion engine and having a wall portion. A damping mass is provided to be coupled to the wall portion. When the damping mass is not coupled to the wall portion, the wall portion resonates at a resonant frequency during engine operation and emits a noise caused by resonation at the resonant frequency. Without the damping mass, the wall portion includes an anti-node region that exhibits a maximum resonant amplitude when the wall portion resonates at the resonant frequency. When the damping mass is coupled to the wall portion at the anti-node region, the resonant frequency of the wall portion is reduced. Reduction of the resonant frequency of the wall portion by coupling the damping mass to the wall portion reduces the radiation efficiency and the noise emissions of the wall portion during engine operation.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
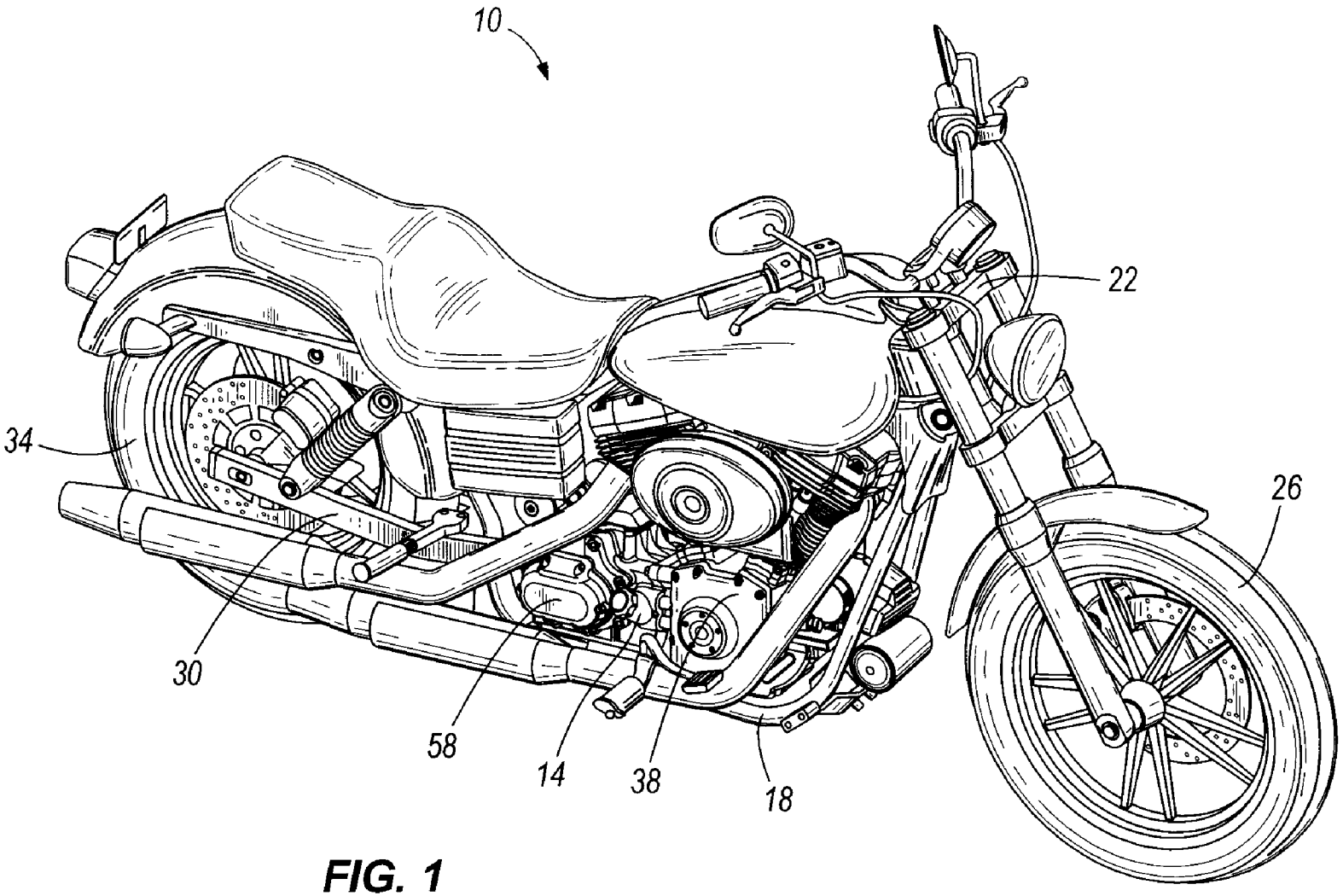
FIG. 1 is a perspective view of a motorcycle including an internal combustion engine embodying the invention.

FIG. 1 illustrates a motorcycle 10 including an internal combustion engine assembly 14 embodying the invention. The motorcycle 10 includes a frame 18, a steering assembly 22 pivotally coupled to a forward portion of the frame 18, and a front wheel 26 rotatably coupled to the steering assembly 22. A swingarm 30 is pivotally coupled to a rearward portion of the frame 18 and a rear wheel 34 is rotatably coupled to the swingarm 30.

Figure 2:
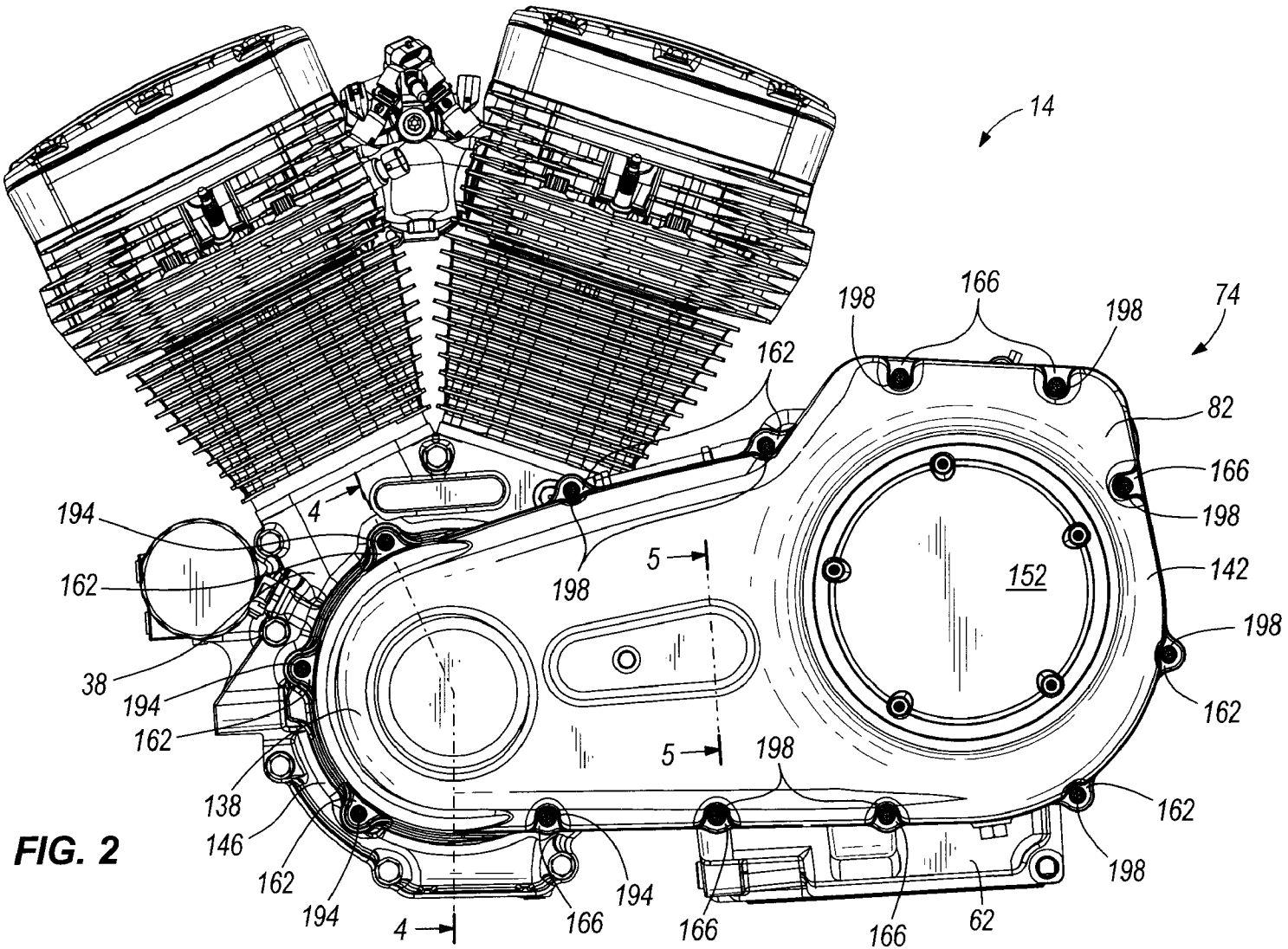
FIG. 2 is a left side view of the engine illustrated in FIG. 1.
Figure 3:
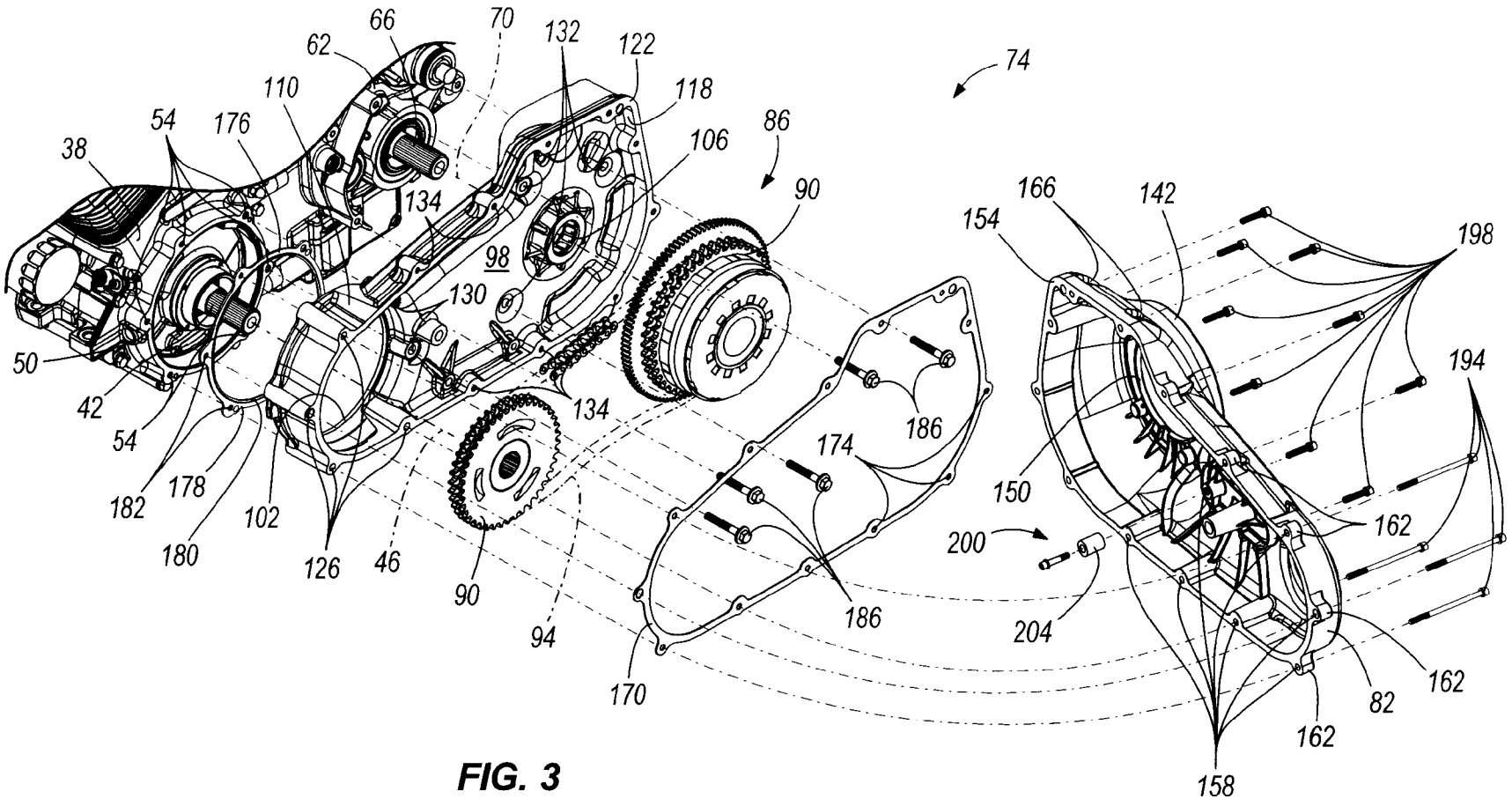
FIG. 3 is an exploded perspective view of a portion of the engine illustrated in FIG. 2.
Figure 4:
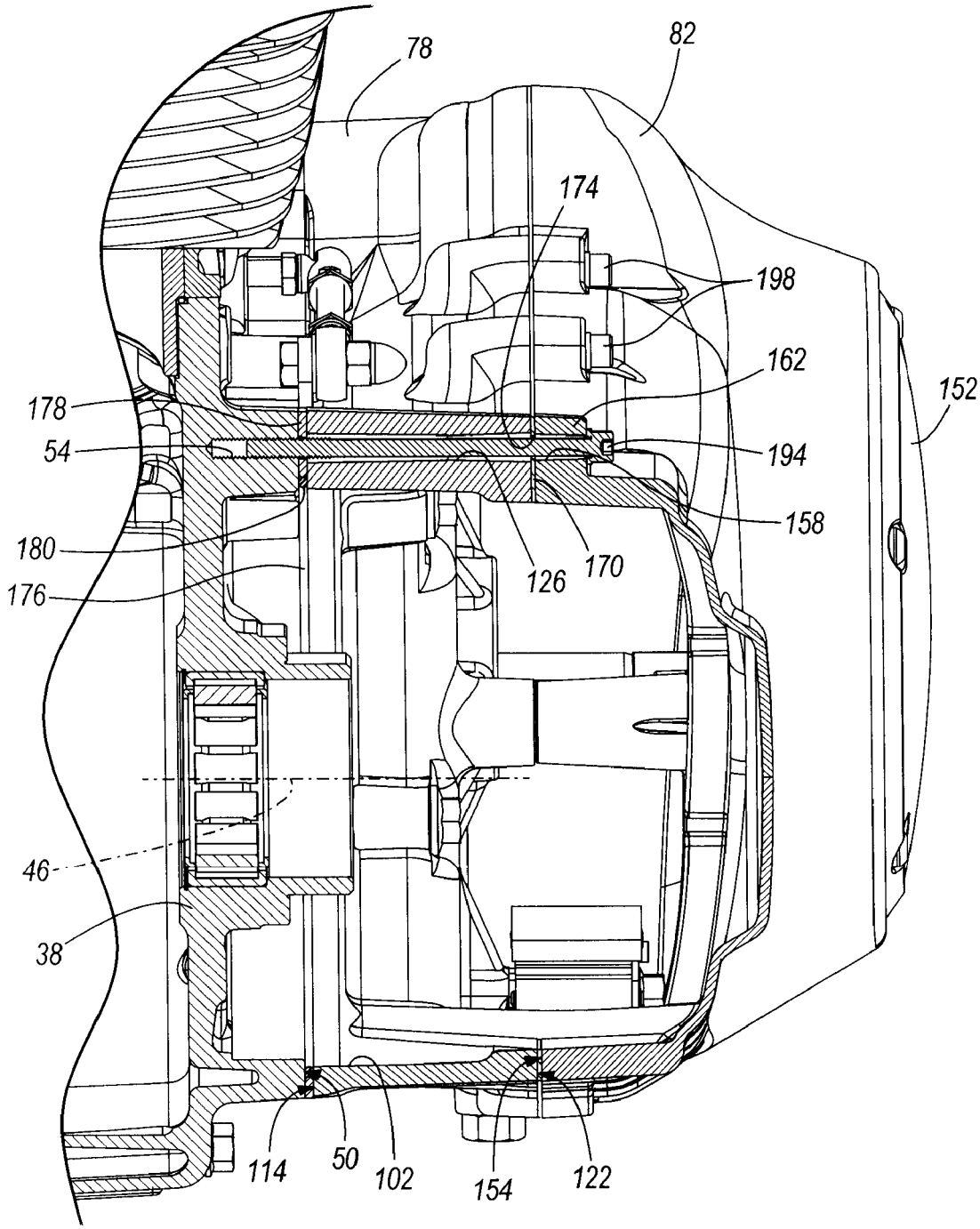
FIG. 4 is a section view taken along line 4-4 of FIG. 2.

FIGS. 2-4 illustrate the engine assembly 14 in further detail. The engine assembly 14 includes a crankcase 38 that rotatably supports a crankshaft 42 for rotation about a crankshaft axis 46. The crankcase 38 defines a substantially planar first surface 50 that extends substantially normal to the crankshaft axis 46. The first surface 50 is continuous and is generally circular in shape, surrounding the crankshaft axis 46. The crankcase 38 also defines a plurality of threaded bores 54 that extend through the first surface 50. The threaded bores 54 extend into the crankcase 38 substantially parallel to the crankshaft axis 46 and are angularly spaced about the crankshaft axis 46. The illustrated crankcase 38 includes six threaded bores 54.

The engine assembly 14 also includes a transmission assembly 58 that is coupled to the crankcase 38. The transmission assembly 58 includes a transmission case 62 that rotatably supports a transmission input shaft 66 for rotation about an input axis 70. The input axis 70 extends substantially parallel to the crankshaft axis 46.

A primary housing assembly 74 includes an inner housing 78 and an outer housing 82 coupled to the inner housing 78. The primary housing assembly 74 houses a primary drive assembly 86 that drivingly couples the crankshaft 42 to the input shaft 66. The illustrated primary drive assembly 86 includes sprockets 90 and a chain 94, however other drive systems incorporating belts and pulleys or gearing arrangements can be used instead.

The inner housing 78 includes an elongated inner housing wall 98 that defines a crankshaft opening 102 that receives the crankshaft 42 and an input shaft opening 106 that receives the input shaft 66. A generally cylindrical wall 110 extends away from the inner housing wall 98 toward the crankcase 38 at a forward end of the inner housing 78. The cylindrical wall 110 defines a second surface 114 that faces and is substantially parallel to the first surface 50 when the inner housing 78 is coupled to the crankcase 38. An outer wall 118 extends away from the inner housing wall 98 in a direction opposite that of the cylindrical wall 110. The outer wall 118 substantially defines an outer perimeter of the inner housing 78 and further defines a first sealing surface 122 that faces away from the crankcase 38.

The cylindrical wall 110 and the outer wall 118 cooperate to define a plurality of external coupling apertures 126 that extend through the first sealing surface 122 and the second surface 114 substantially parallel to the crankshaft axis 46, and which are angularly spaced about the crankshaft axis 46. The inner housing wall 98 and the cylindrical wall 110 cooperate to define a plurality of internal coupling apertures 130. The internal coupling apertures 130 extend through the housing wall 98 and through the second surface 114 substantially parallel to the crankshaft axis 46. The inner housing wall 98 also defines a plurality of transmission coupling apertures 132 near the rearward portion of the inner housing 78 that extend substantially parallel to the crankshaft axis 46. The outer wall 114 defines a plurality of blind bores 134 spaced generally about the rear periphery of the inner housing 78 that extend substantially parallel to the crankshaft axis 46.

The outer housing 82 includes a forward portion 138 and an enlarged rearward portion 142. The forward portion 138 includes an arcuate forward edge 146 that is substantially coaxially aligned with the crankshaft axis 46. The rearward portion 142 defines a circular opening 150 that is substantially coaxially aligned with the input axis 70. A removable clutch cover 152 can be coupled to the opening to afford access to the clutch portion of the primary drive assembly 86 without requiring removal of the outer housing 82.

The outer housing 82 includes an outer perimeter that substantially corresponds to the outer perimeter of the inner housing 78 as defined by the outer wall 114. The outer housing 82 defines a second sealing surface 154 that faces the first sealing surface 122 and is a substantial mirror-image thereof. In the vicinity of the outer perimeter, the outer housing 82 defines a plurality of coupling apertures 158 that extend through the second sealing surface 154. Some of the coupling apertures 158 are defined in protrusions 162 which extend generally outwardly from the outer housing 82, while other coupling apertures 158 are defined in recessed or countersunk portions 166 of the outer housing 82. Each coupling aperture 158 is positioned and configured for alignment with a corresponding one of either the external coupling apertures 126 or the blind bores 134.

The primary housing assembly 74 also includes an outer primary gasket 170 including apertures 174. The outer primary gasket 170 is sandwiched between the first and second sealing surfaces 122, 154 to seal the interface between the inner housing 78 and the outer housing 82. The apertures 174 are positioned along the outer primary gasket 170 for alignment with the external coupling apertures 126 and the blind bores 134 of the inner housing 78. The primary housing assembly 74 also includes an inner primary gasket 176 that is sandwiched between the first surface 50 of the crankcase 38 and the second surface 114 of the inner housing 78. The inner primary gasket 176 surrounds the crankshaft 42 and includes a substantially planar rigid portion 178 and a resilient portion 180 that is coupled to the rigid portion 178. The rigid portion 178 defines a plurality of gasket apertures 182 that can be aligned with the threaded bores 54 of the crankcase 38, and includes a generally circular inner edge. The resilient portion 180 extends circumferentially around the inner edge of the rigid portion 178 and, as seen in FIG. 4, extends axially away from the rigid portion 178 for engagement with the first and second surfaces 50, 114 to seal the interface between the crankcase 38 and the inner housing 78.

The primary housing assembly 74 is coupled to the crankcase 38 and the transmission case 62 in the following manner. The inner housing 78 is coupled to the crankcase 38 by extending inner fasteners 186 through the internal coupling apertures 130 and into the threaded bores 54 in the crankcase 38. The inner fasteners 186 also extend through the gasket apertures 182 defined by the inner primary gasket 176. The inner housing 78 is also coupled to the transmission case 62 by extending inner fasteners 186 through the transmission coupling apertures 132 and into the transmission case 62. When the inner housing 78 is coupled to the crankcase 38 and to the transmission case 62 the crankshaft 42 extends through the crankshaft opening 102 and the input shaft 66 extends through the input shaft opening 106. The primary drive assembly 86 can then be coupled to the crankshaft 42 and the input shaft 66.

The outer housing 82 is then coupled to the inner housing 78 by extending a first set of outer fasteners 194 through the coupling apertures 158 that are adjacent the arcuate forward edge 146 of the outer housing 82. Each fastener 194 of the first set of fasteners extends through the coupling aperture 158, through an aperture 174 in the outer primary gasket 170, through an external coupling aperture 126 of the inner housing 78, through a gasket aperture 182 in the inner primary gasket 176, and into a threaded bore 54 in the crankcase 38. The fasteners 194 therefore couple the outer housing 82 to the inner housing 78, and also couple the inner and outer housings 78, 82 to the crankcase 38. A second set of outer fasteners 198 extend through the remaining coupling apertures 158 of the outer housing 82, through the apertures 174 in the outer primary gasket 170, and into the blind bores 134 of the inner housing 78.

With reference also to FIGS. 5*a*-5*d*, the engine assembly 14 also includes a resonant-damping device 200 coupled to the outer housing 82 to reduce noise emissions from the outer housing 82 during engine operation. Without the resonant damping device, the outer housing 82 resonates at a resonant frequency during engine operation. This resonation emits noise from the outer housing 82. To reduce the noise emitted from the outer housing 82, a damping mass 204 is coupled to the outer housing 82 at an anti-node region of the outer housing 82. The anti-node region is that region of the outer housing 82 that exhibits the greatest deflection when the outer housing 82 resonates at the resonant frequency. The anti-node region can be determined analytically, through finite element analysis or other suitable analytical methods, or can be determined experimentally. It should be appreciated that the exact location of the anti-node itself can be difficult to determine.

As such, positioning the damping mass 204 within the anti-node region, defined as a generally circular area having a diameter of approximately 25% of the largest linear dimension of the outer housing 82, will generally provide acceptable results. Of course the closer the damping mass 204 is positioned to the actual anti-node location the more effective the resonant damping device 200 will be. It should also be appreciated that the outer housing 82 (and any other engine component) has several resonant frequencies and that there may be different anti-node regions for the different resonant frequencies. In this regard, the specific resonant frequency at which it is desired to reduce noise emissions should be selected first, and the resonant damping device 200 can then be positioned accordingly.

Figure 5A:
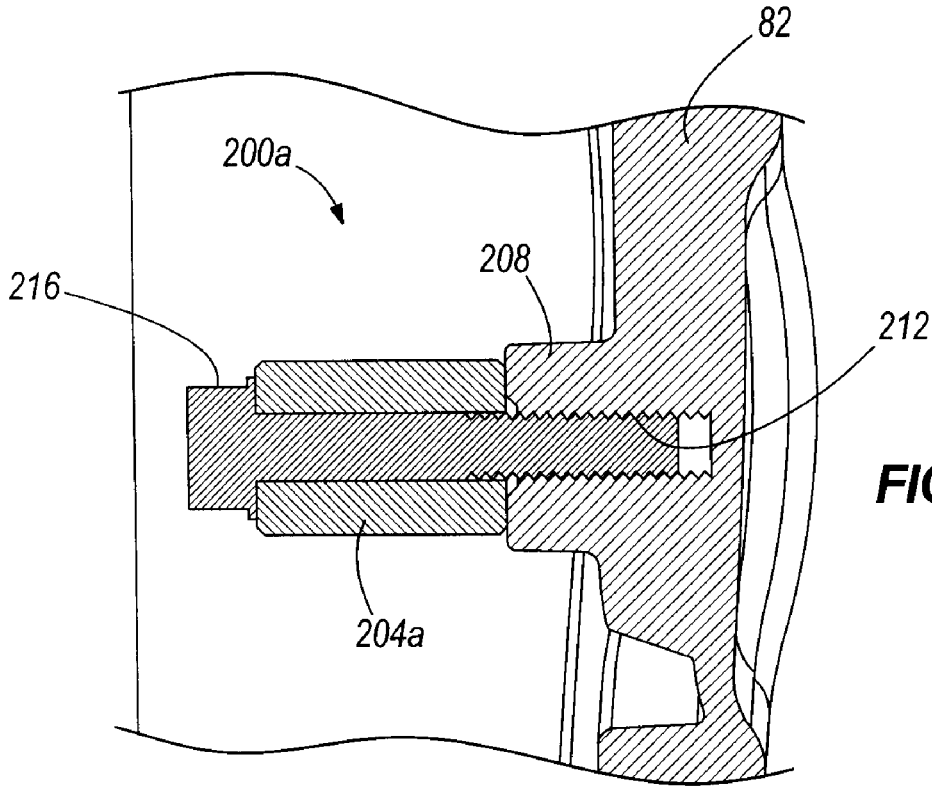
FIG. 5*a* is a section view taken along line 5-5 of FIG. 2 and illustrating a first embodiment of a damping device for the engine.

FIG. 5*a* illustrates a first embodiment of the resonant damping device 200*a* where the damping mass 204*a* is rigidly coupled to the outer housing 82. The outer housing 82 defines a boss 208 that defines a threaded bore 212. The boss 208 is appropriately located within the anti-node region of the outer housing 82. The damping mass 204*a* is in the form of a hollow-cylinder, and is rigidly coupled to the boss 208 by a fastener 216. The rigidly-mounted damping mass 204*a* can take on many different shapes or forms, and can be coupled to the inner wall in a variety of different ways which may include one or more fasteners or clamps. The damping mass 204*a* can also be permanently coupled to the outer housing 82 by welding, adhesives or the like, or the damping mass 204 could be integrally formed (e.g. by casting) with outer housing 82. By positioning the damping mass 204*a* in the anti-node region of the outer housing 82, the resonant frequency of the outer housing 82 is reduced, which in turn reduces the radiation efficiency and noise emission of the outer housing 82 during engine operation.

Figure 5B:
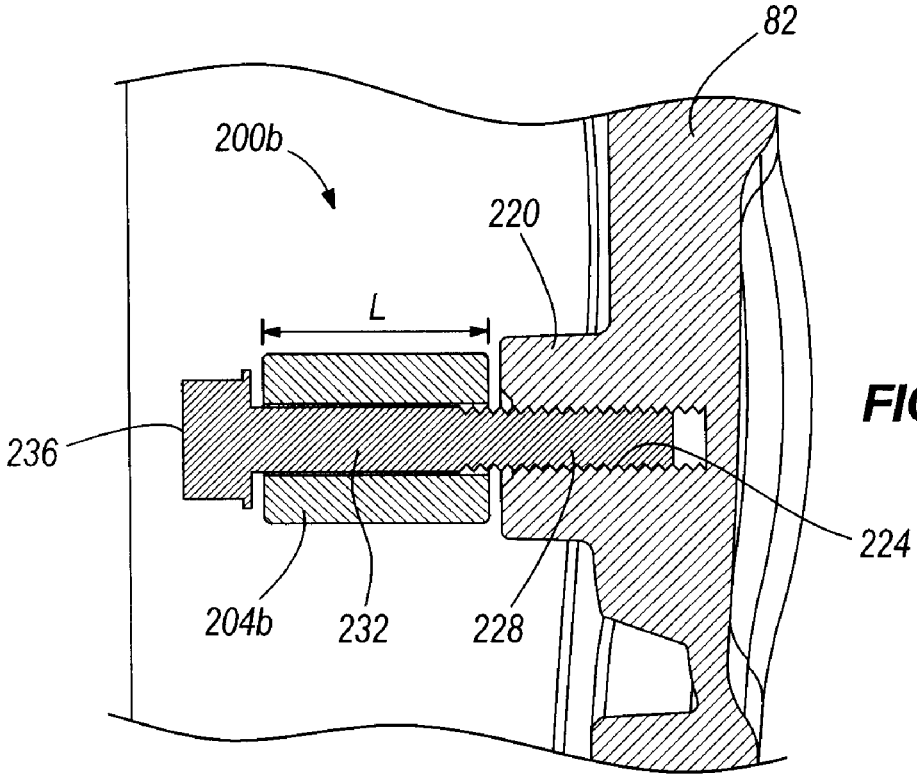
FIG. 5*b* is a section view similar to FIG. 5 illustrating a second embodiment of the damping device for the engine.

FIG. 5*b* illustrates a second embodiment of the resonant damping device 200*b* where the damping mass 204*b* is moveably coupled to the outer housing 82. In the illustrated construction, the outer housing 82 defines a boss 220 including a threaded bore 224. A fastener 228 including a shaft portion 232 and a head portion 236 is received by the threaded bore and extends away from the boss 220. The damping mass 204*b* is in the form of a hollow cylinder and includes a length L. The damping mass 204*b* is supported for sliding movement along the shaft portion 232 between the boss 220 and the fastener head portion 236, the boss 220 and the head portion 236 being separated by a distance greater than the length L. Because the resonant damping device 200*b* is located within the primary housing assembly 58 (see FIG. 3), the device 200*b* is exposed to the liquid lubricant that is provided to lubricate the primary drive assembly 86. When the damping mass 204*b* moves along the shaft portion 232 the lubricant is compressed between the damping mass 204*b* and the fastener head 236 and between the damping mass 204*b* and the boss 220, thereby generating heat which further dissipates the vibration energy of the outer housing 82 to reduce noise emissions from the outer housing 82. Other constructions of the damping device 200*b* are also possible. For example, the shaft portion 232 of the fastener could instead be integrally formed with the outer housing 82, and a nut or other suitable stop member could be used to function in a manner similar to the fastener head portion 236.

Figure 5C:
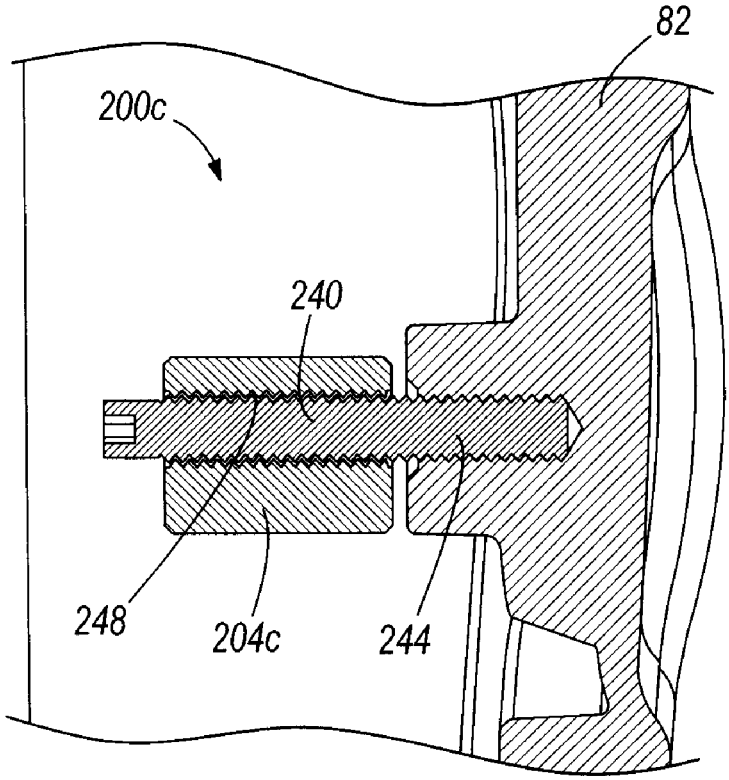
FIG. 5*c* is a section view similar to FIG. 5 illustrating a third embodiment of the damping device for the engine.

FIG. 5*c* illustrates a third embodiment of the resonant damping device 200*c*. The damping device 200*c* operates in a manner similar to that of the damping device 200*b* of FIG. 5*b* in that the damping mass 204*c* is supported for movement along a shaft portion 240 of a threaded fastener 244. The threaded fastener 244 is threaded into the outer housing 82 and is threaded substantially along its entire length. The damping mass 204*c* is in the form of a hollow cylinder having an internally-threaded central bore 248. The central bore 248 is eccentrically positioned with respect to the center of gravity of the damping mass 204*c*. The damping mass 204*c* is threaded onto the shaft portion 240 of the fastener 244. The eccentric nature of the central bore 248 substantially prevents unwanted rotation of the damping mass 204*c* about the shaft portion 240. The thread diameter of the central bore 248 is slightly greater than the thread diameter of the threaded fastener 244 such that small gaps are present between individual threads of the damping mass 204*c* and the threaded fastener 244. Like the damping device 200*b* discussed above, lubricant is compressed between the small thread gaps as the damping mass 204*c* moves along the shaft portion 240 of the fastener, thereby dissipating the vibration energy of the outer housing 82 to further reduce noise emissions from the outer housing 82 during engine operation.

Figure 5D:
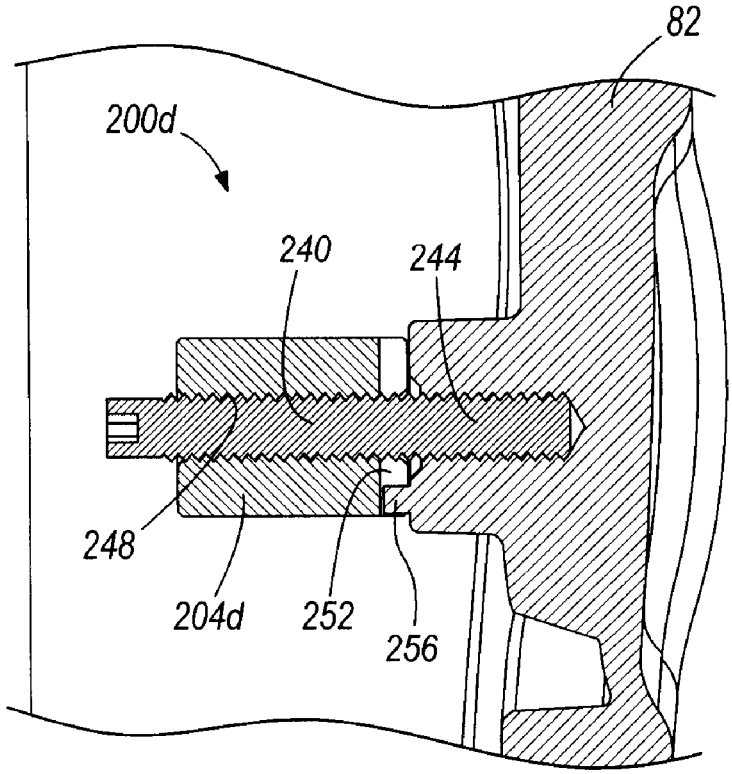
FIG. 5*d* is a section view similar to FIG. 5 illustrating a fourth embodiment of the damping device for the engine.

FIG. 5*d* illustrates a fourth embodiment of the resonant damping device 200*d*. The resonant damping device 200*d* operates in substantially the same manner as the device 200*c* of FIG. 5*c*, whereby lubricant is compressed between small gaps between individual threads of the fastener 244 and the damping mass 204*d*. Unlike the damping mass 204*c* however, the central bore 248 of the damping mass 204*d* is not eccentrically positioned. To prevent rotation of the damping mass 204*d* about the fastener 244, the damping mass 204*d* is provided with a groove 252 that receives a tang 256 formed as part of the outer housing 82. Of course there are several possible variations on the structural configurations and components illustrated and described above that would be suitable for prevention rotation of the damping mass 204*d* with respect to the fastener 244, each of which is within the spirit and scope of the invention.

Various features and advantages of the invention are set forth in the following claims.

We claim:

1. An internal combustion engine comprising:

an engine component adapted to be coupled to the internal combustion engine, the engine component having a wall portion, the wall portion including a boss extending outwardly from the wall portion in a first direction; and a damping mass coupled to the wall portion at the location of the boss, wherein the wall portion without the damping mass resonates at a resonant frequency during engine operation, the wall portion without the damping mass emitting a noise caused by resonation at the resonant frequency, the wall portion without the damping mass including an anti-node region exhibiting a maximum resonant amplitude when the wall portion without the damping mass resonates at the resonant frequency, wherein the damping mass is coupled to the wall portion at the anti-node region to reduce the resonant frequency of the wall portion, thereby reducing the radiation efficiency and noise emissions of the wall portion during engine operation, and wherein the damping mass is rigidly coupled to the wall portion and at least a portion of the damping mass extends from the boss in the first direction.

2. The internal combustion engine of claim 1, wherein the boss defines a threaded bore, and wherein the damping mass is bolted to the boss.

3. The internal combustion engine of claim 1, wherein the engine component is a primary drive housing including an inner primary housing and an outer primary housing, and wherein the outer primary housing defines the wall portion.

4. The internal combustion engine of claim 1, further comprising a fastener engaging the boss and coupling the damping mass to the wall portion.

5. The internal combustion engine of claim 1, wherein the damping mass is hollow and substantially cylindrical.

6. The internal combustion engine of claim 1, wherein the location of the boss is the singular location at which the damping mass is coupled to the wall portion.

7. A motorcycle comprising:

a frame;

a steering assembly including a front wheel supporting a forward portion of the frame;

a rear wheel supporting a rearward portion of the frame;

an engine assembly coupled to the frame, the engine assembly including:

an engine component having a wall portion, the wall portion including a boss extending outwardly from the wall portion in a first direction; and a damping mass coupled to the wall portion at the location of the boss, wherein the wall portion without the damping mass resonates at a resonant frequency during engine operation, the wall portion without the damping mass emitting a noise caused by resenation at the resonant frequency, the wall portion without the damping mass including an anti-node region exhibiting a maximum resonant amplitude when the wall portion without the damping mass resonates at the resonant frequency, wherein the damping mass is coupled to the wall portion at the anti-node region to reduce the resonant frequency of the wall portion, thereby reducing the radiation efficiency and noise emissions of the wall portion during engine operation, and wherein the damping mass is rigidly coupled to the wall portion and at least a portion of the damping mass extends from the boss in the first direction.

8. The motorcycle of claim 7, wherein the boss defines a threaded bore, and wherein the damping mass is bolted to the boss.

9. The motorcycle of claim 4, wherein the engine component is a primary drive housing including an inner primary housing and an outer primary housing, and wherein the outer primary housing defines the wall portion.

10. The motorcycle of claim 4, further comprising a fastener engaging the boss and coupling the damping mass to the wall portion.

11. The motorcycle of claim 4, wherein the damping mass is hollow and substantially cylindrical.

12. The motorcycle of claim 4, wherein the location of the boss is the singular location at which the damping mass is coupled to the wall portion.

13. An internal combustion engine comprising:

an engine component adapted to be coupled to the internal combustion engine, the engine component having a wall portion; and a damping mass coupled to the wall portion, wherein the wall portion without the damping mass resonates at a resonant frequency during engine operation, the wall portion without the damping mass emitting a noise caused by resonation at the resonant frequency, the wall portion without the damping mass including an anti-node region exhibiting a maximum resonant amplitude when the wall portion without the damping mass resonates at the resonant frequency, wherein the damping mass is coupled to the wall portion at the anti-node region to reduce the resonant frequency of the wall portion, thereby reducing the radiation efficiency and noise emissions of the wall portion during engine operation, wherein the damping mass is moveably coupled to the wall portion, the wall portion including a projection that defines an axis, the damping mass being supported by the projection for axial movement along the projection, and wherein the wall portion includes flange portions at opposite ends of the projection, the flange portions spaced by a first distance that is greater than a length of the damping mass and limiting axial movement of the damping mass along the projection.

14. The internal combustion engine of claim 13, wherein the damping mass is hollow and substantially cylindrical.

15. The internal combustion engine of claim 13, wherein the engine component is a primary drive housing including an inner primary housing and an outer primary housing, and wherein the outer primary housing defines the wall portion.

16. An internal combustion engine comprising:

an engine component adapted to be coupled to the internal combustion engine, the engine component having a wall portion; and a damping mass coupled to the wall portion, wherein the wall portion without the damping mass resonates at a resonant frequency during engine operation, the wall portion without the damping mass emitting a noise caused by resonation at the resonant frequency, the wall portion without the damping mass including an anti-node region exhibiting a maximum resonant amplitude when the wall portion without the damping mass resonates at the resonant frequency, wherein the damping mass is coupled to the wall portion at the anti-node region to reduce the resonant frequency of the wall portion, thereby reducing the radiation efficiency and noise emissions of the wall portion during engine operation, wherein the damping mass is moveably coupled to the wall portion, the wall portion including a projection that defines an axis, the damping mass being supported by the projection for axial movement along the projection, wherein the projection includes an externally threaded portion having a first thread diameter, and the damping mass defining a threaded bore having a second thread diameter larger than the first thread diameter, and wherein when the damping mass is supported by the projection, the externally threaded portion and the internally threaded portion cooperate to define gaps between individual threads, thereby affording limited axial movement of the damping mass along the axis.

17. The internal combustion engine of claim 16, wherein a center of gravity of the damping mass is eccentrically spaced from the threaded bore to substantially prevent rotation of the damping mass about the axis during engine operation.

18. The internal combustion engine of claim 16, wherein the damping mass defines one of a notch and a projection, and wherein the mount defines the other of a notch and a projection, the notch and the projection cooperating to substantially prevent rotation of the damping mass about the axis during engine operation.

19. The internal combustion engine of claim 16, wherein the damping mass is hollow and substantially cylindrical.

20. The internal combustion engine of claim 16, wherein the engine component is a primary drive housing including an inner primary housing and an outer primary housing, and wherein the outer primary housing defines the wall portion.

* * * * *

UNITED STATES PATENT AND TRADEMARK OFFICE

CERTIFICATE OF CORRECTION

PATENT NO. : 7,395,799 B2
APPLICATION NO. : 11/550550
DATED : July 8, 2008
INVENTOR(S) : Paul Nan-Jiune Liang et al.

It is certified that error appears in the above-identified patent and that said Letters Patent is hereby corrected as shown below:

Col 7,
In Claim 7, line 24:

change “resenation” to --resonation--

Col 7,
In Claim 9, line 40:

change “claim 4” to --claim 7--

Col 7,
In Claim 10, line 44:

change “claim 4” to --claim 7--

Col 7,
In Claim 11, line 47:

change “claim 4” to --claim 7--

Col 7,
In Claim 12, line 49:

change “claim 4” to --claim 7--

Signed and Sealed this

Twelfth Day of May, 2009

John Doll

JOHN DOLL
*Acting Director of the United States Patent and Trademark Office*